United States Patent [19]

Merrill et al.

[11] 4,171,275

[45] Oct. 16, 1979

[54] LIQUID ELECTROGRAPHIC DEVELOPER

[75] Inventors: Stewart H. Merrill; Alec N. Mutz; Frederick A. Stahly, all of Rochester, N.Y.

[73] Assignee: Eastman Kodak Company, Rochester, N.Y.

[21] Appl. No.: 824,131

[22] Filed: Aug. 12, 1977

[51] Int. Cl.[2] ..... G03G 9/12

[52] U.S. Cl. ..... 252/62.1 L; 96/1 LY

[58] Field of Search ..... 252/62.1 P, 62.1 L; 96/1 LY; 427/15

[56] References Cited

U.S. PATENT DOCUMENTS

| | | | |
|---|---|---|---|
| 3,681,243 | 8/1972 | Okuno et al. | 252/62.1 L |
| 3,793,015 | 2/1974 | Van Engeland et al. | 252/62.1 L |
| 3,849,165 | 11/1974 | Stahly | 252/62.1 L |

FOREIGN PATENT DOCUMENTS

| | | | |
|---|---|---|---|
| 51-344 | 1/1976 | Japan | 252/62.1 L |
| 1352067 | 5/1974 | United Kingdom | 252/62.1 L |
| 1436795 | 5/1976 | United Kingdom | 252/62.1 L |

*Primary Examiner*—Dennis E. Talbert, Jr.
*Assistant Examiner*—John L. Goodrow
*Attorney, Agent, or Firm*—William T. French

[57] ABSTRACT

Liquid developers for electrography comprise an electrically insulating carrier liquid containing (1) an addition polymer comprising a polar moiety and at least one additional moiety having predetermined solubility characteristics with respect to the carrier liquid, (2) a polymer comprising a phosphonate moiety, and (3) a halogenated polymer.

5 Claims, No Drawings

LIQUID ELECTROGRAPHIC DEVELOPER

Field of the Invention

This invention relates to electrography and more particularly to novel liquid developer compositions and their use in the development of electrostatic charge patterns.

Background of the Invention

Electrographic imaging and development processes, e.g., electrophotographic imaging processes and techniques, have been extensively described in both the patent and other literature, for example, U.S. Pat. Nos. 2,221,776, issued Nov. 19, 1940; 2,277,013, issued Mar. 17, 1942; 2,297,691, issued Oct. 6, 1942; 2,357,809, issued Sept. 12, 1944; 2,551,582, issued May 8, 1951; 2,825,814, issued Mar. 4, 1958; 2,833,648, issued May 6, 1958; 3,220,324, issued Nov. 30, 1965; 3,220,831, issued Nov. 30, 1965; 3,220,833, issued Nov. 30, 1965, and many others. Generally, these processes have in common the steps of forming a latent electrostatic charge image on an insulating electrographic element, such as a photoconductive insulating layer coated on a conductive support. The electrostatic latent image is then rendered visible by a development step in which the charge image-bearing surface of the electrographic element is brought into contact with a suitable developer composition.

Many types of developer compositions, including both dry developer compositions and liquid developer compositions, have been proposed heretofore for use in the development of latent electrostatic charge images. Dry developer compositions typically suffer from the disadvantage that distribution of the dry toner powder contained therein on the surface of the electrographic element bearing the electrostatic latent image is difficult to control. These dry developers have the further disadvantage that the use thereof may create excessive amounts of dust and that high resolution is often difficult to obtain due to the generally relatively large size of the dry developer powder particles.

Many of the disadvantages accompanying the use of dry developer compositions have been avoided in the past by the use of a liquid developer of the type described, for example, in Metcalfe et al, U.S. Pat. No. 2,907,674, issued Aug. 6, 1959. Such developers usually comprise an electrically insulating liquid which serves as a carrier and which contains a stable dispersion of charged particles known as toner particles comprising a pigment such as carbon black, generally associated with a resinous binder, such as, for example, an alkyd resin. A charge control agent is often included to stabilize the magnitude and polarity of the charge on the toner particles. In some cases, the binder itself serves as a charge control agent.

To achieve suitable physical stability of the toner particles dispersed in conventional liquid electrographic developers, any of several types of various "stabilization" additives are incorporated in such a liquid developer to prevent the toner particles from settling out of the carrier liquid. Typical of such additives are those described in York, U.S. Pat. No. 2,899,335, issued Aug. 11, 1955, and various types of dispersants as described, for example, in British Pat. No. 1,065,796.

Liquid developers for electrography should have suspension and charge stability and produce images that do not smear, have high image density and resolution, and low background. Various additives have been suggested to control or effect one or more of these desirable properties. However, it remains difficult to formulate liquid developers for electrography that achieve all or most of the desirable properties listed above.

A liquid developer comprising (1) a bivalent or trivalent metal salt of an oxyacid derived from phosphorus containing at least one organic residue and (2) one or more members selected from the group consisting of amines, polyurethanes and alkylated polymers of a heterocyclic N-vinyl monomer is described in U.S. Published Patent Application B376,749, published Mar. 30, 1976. U.S. Pat. No. 3,912,645, issued Oct. 14, 1975, describes an improved liquid developer comprising an aryl-alkyl phosphite. British Pat. No. 1,427,273, published Mar. 10, 1976 describes liquid developers containing chlorinated paraffin and including a vinyl toluene resin. U.S. Pat. No. 3,674,693, issued July 4, 1972 describes a liquid developer containing a polymeric binder and a phospholipid charge stabilizing material.

However, there remains a need for improved liquid electrographic developers having the combined properties of suspension and charge stability and that produce images that do not smear, have high image density and resolution, and low background.

SUMMARY OF THE INVENTION

The present invention provides a liquid electrographic developer comprising an electrically-insulating carrier liquid having dispersed therein, an addition polymer comprising a polar moiety and at least one additional moiety, said polymer having predetermined solubility characteristics with respect to the carrier liquid, a soluble polymer comprising a phosphonate moiety, and a halogenated polymer.

DETAILED DESCRIPTION OF THE INVENTION

Liquid electrographic developers in accord with this invention exhibit, among other things, improved suspension and charge stability and produce images that do not smear, have high image density and resolution, and have low background.

As used in the present specification the solubility of a particular polymer or copolymer in a particular developer carrier liquid is defined by the following test. A 4.0 gram quantity of copolymer to be tested is admixed into one liter of a particular developer carrier liquid using a Waring or Polytron Blender operating within the range of 10,000 to 18,000 rpm. This mixture is then centrifuged at 34,000 G forces for about 60 minutes. At the end of this time, the mixture is analyzed to determine the amount of polymer which has precipitated. To form the stable developers of the present invention, it has been determined that the soluble polymers useful in the practice of this invention should be soluble to the extent that at least about 3.3 grams of the original 4.0 gram quantity of polymer remain suspended or dissolved in the carrier liquid after centrifuging. A solubility ratio is then calculated as the amount of polymer which remains suspended in the carrier liquid divided by the 4.0 grams of polymer originally mixed into the carrier liquid. A solubility ratio of 0.825 is equivalent to 3.3 divided by 4.0.

Liquid electrographic developers in accord with this invention, as described above, comprise an addition polymer having a predetermined solubility characteristic with respect to the carrier liquid as defined above. Useful such polymers containing a polar moiety are described in Stahly et al U.S. Pat. No. 3,849,165, issued Nov. 19, 1974, the disclosure of which is hereby incorporated by reference. The polar moiety is generally present in the polymer in an amount of at least about $1.5\times10^{-4}$ moles/gm of polymer. The moieties from which the polar moiety can be selected include the following groups:

a. sulfoalkyl acrylates such as compounds having the formula:

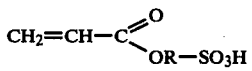

where R is an alkylene group;

sulfoalkyl methacrylates such as compounds having the formula:

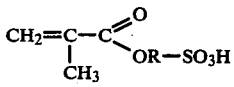

where R is an alkylene group;

c. metal salts of sulfoalkyl acrylates such as compounds having the formula:

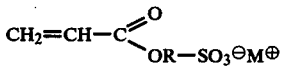

where R is an alkylene group and $M^{\oplus}$ is a metal cation;

d. metal salts of sulfoalkyl methacrylates such as compounds having the formula:

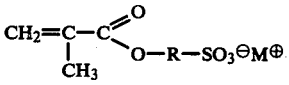

where R is an alkylene group and $M^{\oplus}$ is a metallic cation;

e. amine salts of sulfoalkyl acrylates such as compounds having the formula:

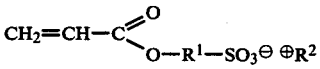

where $R^1$ is an alkylene group and $\oplus R^2$ is a cation formed from an amine;

f. amine salts of sulfoalkyl methacrylate such as compounds having the formula:

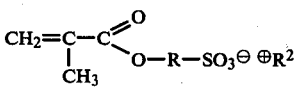

where R is an alkylene group and $\oplus R^2$ is a cation formed from an amine;

g. metal salts of acrylic and methacrylic acids such as compounds having the formula:

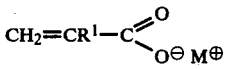

where $R^1$ is H or methyl and $M^{\oplus}$ is a metallic cation; and h. amine salts of acrylic and methacrylic acid such as compounds having the formula:

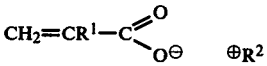

where $R^1$ is H or methyl and $\oplus R^2$ is a cation formed from an amine; and mixtures thereof.

Comonomers useful for polymerizing with the above polar moieties to obtain the required solubility characteristic for the polar moiety containing polymer are described in U.S. Pat. No. 3,849,165 which is hereby incorporated by reference.

A second component of the liquid electrographic developers of this invention is a soluble, phosphonate moiety-containing polymer. The phosphonate moiety-containing polymers comprise one or more

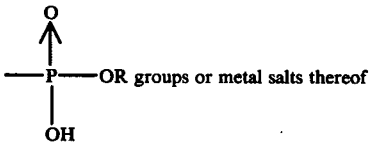

wherein

R may be hydrogen, alkyl or aryl, including the substituted forms thereof. The phosphorus atom is covalently bonded to carbon. Particularly useful results are obtained when the phosphonic acid content of the polymer is from about 0.1% to about 10%, expressed as phosphorus. Polymers of this type are described in copending U.S. application Ser. No. 824,135, filed Aug. 12, 1977, in the names of S. H. Merrill and D. Santelli and entitled "Liquid Electrographic Developer Comprising Polymeric Phosphonate Dispersing Agent".

Preferably, the phosphonate moiety-containing polymer is a polymer of addition comprising a recurring phosphonate moiety derived from monomer having the formula:

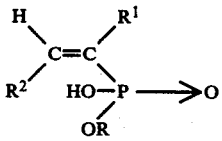

or

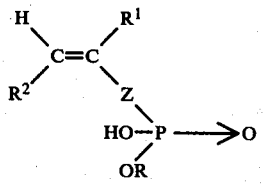

wherein:

R is hydrogen, an alkyl group, or an aryl group;

$R^1$ is hydrogen or a lower alkyl group having from 1 to about 4 carbon atoms;

$R^2$ is hydrogen or an alkyl group; and

Z is alkylene or arylene.

For the purpose of the invention described herein, phosphonate metal salts of the above monomers ae considered to be their equivalent. Specific examples of such phosphonate moiety-containing monomers useful in the practice of this invention include: ethyl hydrogen p-vinylbenzylphosphonate; ethyl lithium p-vinylbenzylphosphonate; 1-hydroxy-1-methyl-2-propenylphosphonic acid; vinylphosphonic acid; lithium hydrogen vinylphosphonate; etc. It should be noted that the phosphonate moiety-containing polymers of this invention can also be made by polymerizing monomers that can be phosphorylated. For example, a carbonyl-containing polymer can be phosphorylated by the procedure described by Marvel and Wright in *Journal of Polymer Science,* Volume 8, p. 495 (1952). Phosphonate moiety-containing polymers made by this or eqivalent procedures are contemplated within the scope of this invention.

Any suitable monomer can be copolymerized with the phosphonate moiety containing monomers to produce co-polymers useful in the liquid developers of this invention as long as the resulting co-polymer has the required solubility as defined above. Representative type A monomers that can generally be copolymerized with phosphonic acid containing monomers to form phosphonate moiety-containing copolymers used in the liquid developers of the invention may be selected from the following:

a. alkylstyrenes such as compounds having the formula

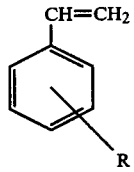

where R is an alkyl having from about 3 to about 10 carbon atoms in the alkyl moiety;

b. alkoxystyrenes such as compounds having the formula

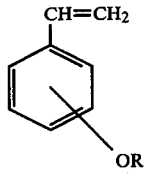

where R is an alkyl having from about 3 to about 10 carbon atoms in the alkyl moiety, for example, p-amyloxystyrene;

c. alkyl acrylates such as compounds having the formula

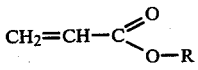

where R is an alkyl having from about 8 to about 22 carbon atoms in the alkyl moiety;

d. alkyl methacrylates such as compounds having the formula

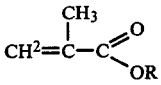

where R is an alkyl having from about 8 to about 22 carbon atoms in the alkyl moiety;

e. vinyl alkyl ethers such as compounds having the formula $$CH_2{=}CH{-}O{-}R$$

where R is an alkyl having from about 8 to about 22 carbon atoms in the alkyl moiety; and f. vinyl esters of aliphatic acids such as compounds having the formula

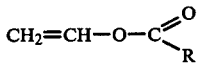

where R is an alkyl having from about 6 to about 22 carbon atoms in the alkyl moiety; and mixtures thereof.

Preferred type A comonomers contained in the phosphonate moiety containing copolymers used in the preparation of the liquid developers of the invention generally include the following:

a. alkylstyrenes having from about 5 to about 10 carbon atoms in the alkyl moiety;

b. alkyl acrylates and methacrylates having from about 12 to about 22 carbon atoms in the alkyl moiety; and c. vinyl esters of aliphatic acids having from about 10 to about 22 carbon atoms in the alkyl moiety;

and mixtures thereof.

Representative such type A monomers include the following:

4-pentylstyrene
4-hexylstyrene
4-octylstyrene
lauryl acrylate
hexadecyl methacrylate
octadecyl methacrylate
eicosyl acrylate
docosyl methacrylate
vinyl caprate
vinyl laurate
vinyl palmitate
vinyl stearate
vinyl eicosate
vinyl docosate
and mixtures thereof.

Generally, it has been found that if a Type A comonomer such as described above is present in the phosphonate moiety containing copolymer to the extent of at least about 35 weight percent of the polymer, a copolymer is obtained capable of forming a substantially stable dispersion in a typical carrier liquid. Generally, the phosphonate moiety-containing monomer is present in an amount not in excess of about 20 weight percent of the polymer. If no further monomer moiety is present, then, it is preferred that the type A monomer be present in the extent of at least about 84 weight percent of the polymer.

Preferred phosphonate moiety containing copolymers used in the preparation of the liquid developers of the invention also contain at least one type B monomer or group copolymerized with the aforementioned phosphonate moiety-containing monomer and type A monomer. Representative type B comonomers which may be suitable for being so copolymerized include the following:

a. styrenes selected from the group of styrene, methylstyrene, methoxystyrene and halogenated styrene;

b. alkyl acrylates having from about 1 to about 4 carbon atoms in the alkyl moiety;

c. alkyl methacrylates having from 1 to about 4 carbon atoms in the alkyl moiety;

d. vinyl alkyl ethers having from 1 to about 4 carbon atoms in the alkyl moiety; and e. vinyl esters of aliphatic acids having from about 1 to about 4 carbon atoms in the alkyl moiety; and mixtures thereof.

Preferred type B comonomers contained in the phosphonate moiety-containing copolymers used in the preparation of the subject liquid developers generally include the following:

a. styrene and methylstyrene;

b. alkyl acrylates having from 1 to about 4 carbon atoms in the alkyl moiety;

c. alkyl methacrylates having from 1 to about 4 carbon atoms in the alkyl moiety; and d. vinyl esters of aliphatic acids having from 1 to about 4 carbon atoms in the alkyl moiety;

and mixtures thereof. Typical type B comonomers or groups which can be so used include the following:

styrene
α-methylstyrene
ethyl acrylate
methyl acrylate
butyl acrylate
ethyl methacrylate
propyl methacrylate
butyl methacrylate
vinyl acetate
vinyl propionate
vinyl butyrate
and mixtures thereof.

These type B comonomers typically have an effect of reducing the solubility of the resulting copolymer. Therefore, when used, they must not be present in sufficient quantity to reduce the solubility below that required as defined above.

It will be apparent that the choice of particular type A comonomer, type B comonomer, and phosphonate moiety containing monomer is determined by a number of factors. The degree of solubility in the carrier liquid may be controlled by proper adjustment of the ratio of type A comonomer to type B comonomer. In addition, the nature of the particular type A monomeric moiety, such as the degree of solubility of a homopolymer comprising it, will influence the particular type B monomeric moiety chosen to copolymerize with it to give the final polymer. For example, if the type A monomer is one having a relatively long alkyl group attached to it, rendering a polymer containing it relatively soluble, the type B monomer is desirably one having a relatively short alkyl group attached to it, to balance the properties. On the other hand, a relatively short alkyl group on the type A monomer in general requires a somewhat longer alkyl group on the type B monomer. Generally, as indicated above, useful polymers of the present invention are dispersible in the carrier liquid to the extent that if a 4.0 gram quantity of polymer is added to one liter of carrier, at least about 3.3 grams will remain dispersed therein after centrifuging the mixture at 34,000 G forces for about 60 minutes.

Phosphonate moiety-containing polymers useful in the liquid developers of this invention typically have an inherent viscosity in the range of from about 0.1 to about 0.8. The determination is made at a concentration of 0.25 grams of polymer in 100 ml. of chloroform at a temperature of 25° C. The resultant polymers containing recurring units of one or more moieties derived from type A monomers, one or more moieties derived from type B monomers, and one or more moieties derived from phosphonate moiety containing monomers. In general, a typical polymer used in the liquid developers of the invention contains from about 35 to about 70 weight percent of type A moieties, from about 30 to about 65 weight percent of type B moieties and from about 1.5 to about 20 weight percent of phosphonate containing moieties. Preferred polymers useful in this invention contain from about 40–55 weight weight type A moiety, from about 35–55 weight percent of type B moiety and from 1.5–16 percent phosphonate containing moiety. The solubility of the polymer can be adjusted as desired by proper balancing of the relative abundance of the type A and type B moieties. The relative amount of phosphonate containing moiety can be varied to provide polymers having different charge properties when incorporated into a liquid developer. Mechanical properties such as abrasion resistance, and fixability of the resultant toner image can also be adjusted at will by properly balancing the ratio of the compounds in the polymer.

A third component of the liquid electrographic developers of this invention is a halogenated polymer. Typical useful such halogenated polymers include, for example, halogenated polyolefins such as chlorinated polyethylene and chlorinated polypropylene, halogenated paraffins, halogenated rubbers, poly(vinyl chloride-co-vinylidene chloride), and the like, and mixtures thereof.

The liquid electrographic developers of this invention typically contain from about 0.01% to about 5% by weight of polar-moiety-containing polymer, from about 0.01% to about 5% by weight of phosphonate moiety containing polymer, and from 0.01% to about 5% by weight of halogenated polymer. Preferred developers of this invention contain from about 0.02% to about 0.5% by weight of polar moiety containing polymer, from about 0.02% to about 0.5% by weight phosphonate moiety-containing polymer, and from about 0.02% to about 0.5% by weight halogenated polymer.

Liquid developers containing the polymers described herein typically comprise a dispersion of the polymers in a suitable carrier liquid. A common method of preparing such a dispersion is solvent milling. A quantity of the polymer is dissolved in a suitable solvent and the solution placed in a ball mill. Pigments and other additives which may be necessary or desirable are added to the mix and the whole milled for a suitable time, typically up to about 15 days. Alternatively, a viscous solution of the polymer is placed on compounding rolls having chilled (5° to 10° C.) water passing through the cooling system. Pigments and other additives, when used, are then placed on the rolls and throughly mixed and blended with the polymer. The pigment is generally present in an amount of from about 200 to about 10 percent of the weight of the resin. After passing the complete mix through the mill several times to completely blend the ingredients, the mix is removed.

Liquid developers are made from the toner concentrate formed as above by dispersing the concentrate in a suitable electrically insulating carrier liquid. Carrier liquids which may be used to form such developers can be selected from a wide variety of materials. Preferably, the liquid has a low dielectric constant and a very high electrical resistance such that it will not disturb or destroy the electrostatic charge pattern being developed. In general, useful carrier liquids should have a dielectric constant of less than about 3, should have a volume resistivity greater than about $10^{10}$ ohm-cm and should be stable under a variety of conditions. Suitable carrier liquids include halogenated hydrocarbon solvents, for example, fluorinated low alkanes, such as trichloroltrifluoroethane. Hydrocarbon solvents are useful, such as isoparaffinic hydrocarbons having a boiling range of from about 145° C. to about 185° C., such as Isopar G (Exxon Corporation) or cyclohydrocarbons such as cyclohexane. Additional carrier liquids which may be useful in certain situations include polysiloxanes, odorless mineral spirits, octane, etc.

Although it is possible to use resinous copolymers to prepare liquid developers without further addenda, as in situations in which a colorless image is desired, it is customary to add a colorant to give the image optical density. Useful colorants can be selected from a variety of materials such as dyestuffs or pigments. Virtually any of the compounds mentioned in the "Color Index", Second Edition, 1956, Vols. I and II, may in principle, be used. Included among the vast number of useful colorants would be such materials as Hansa Yellow G (C.I. 11680), Nigrosine Spirit soluble (C.I. 50415), Chromogen Black ETOO (C.I. 14645), Rhodamine B (C.I. 45170), Solvent Black 3 (C.I. 26150), Fuchsine N (C.I. 42510), C.I. Basic Blue 9 (C.I. 52015), etc. Another useful class of colorants is comprised of nigrosine salts of mono- and difunctional organic acids having from about 2 to about 20 carbon atoms such as chloroacetic acid, stearic acid, sebacic acid, lauric acid, azelaic acid, adipic acid, abietic acid and the like. Nigrosine salts of this type are disclosed in Olson, U. S. Pat. No. 3,647,696 issued Mar. 7, 1972.

Other colorants suitable for use in preparing liquid developers from the polymers described herein include salts of water-soluble acid dyes, more particularly the metal, alkali metal and ammonium salts of dyes having sulfonic and/or carboxylic acid groups contained thereon. Exemplary of these are the lead salt of copper phthalocyanine tetrasulfonic acid and the magnesium salt of 1-(p-sulfophenyl-3-phenyl)-4-(2.5-dichloro-4-sulfophenylazo)-5-pyrazolone. These colorants are more particularly described in Chechak, U.S. Pat. No. 3,770,638, issued Nov. 6, 1973. Particularly useful colorants are pigments prepared from the reaction of a strongly acid dye with a strongly basic dye to form a highly insoluble precipitate having essentially no color dilution. These pigments and their method of preparation are more fully disclosed in Chechak, British Pat. No. 1,343,790, issued Mar. 15, 1974.

The following examples are included for a further understanding of the invention. Unless otherwise indicated in the examples all percentages are weight percents. Also, the numbers immediately following the name of a copolymer indicate the percent by weight of the respective monomers in that copolymer. For instance, poly(vinyltoluene-co-lauryl methacrylate-co-ethyl hydrogen p-vinylbenzylphosphonate) (47/47/6) consists of 47 weight percent vinyltoluene monomers, 47 weight percent lauryl methacrylate monomers, and 6 weight percent ethyl hydrogen p-vinylbenzylphosphonate.

EXAMPLE 1

Control

A concentrated liquid toner was prepared by dissolving 3.5 g of poly(vinyltoluene-co-lauryl methacrylate-co-lithium methacrylate-co-methacrylic acid) (56/40/3.60.4) or VT polymer in 45 g of Solvesso 100 (Exxon Corporation), and adding 3.5 g of Peerless 155 Carbon (Columbian Carbon Co.). The mixture was ball milled for 15 days using ⅛-inch steel balls.

A working strength liquid developer was prepared by mixing 2.6 g of the above concentrate containing 0.175 g carbon and 0.175 g VT stabilizer with 0.6 g of a polymeric phosphonate stabilizer, containing 0.0875 g of poly(vinyltoluene-co-lauryl methacrylate-co-ethyl hydrogen p-vinylbenzylphosphonate) (47/47/6) and 0.5125 g of Solvesso 100 plus 3.45 g of Solvesso 100. The mixture was injected into 500 ml of Isopar G with an ultrasonic horn.

The developer had a particle size of $<1\mu$ and was used to develop an electrostatic charge pattern formed on an organic photoconductor coated on a film base.

Images obtained were of poor quality, i.e., low density and contrast ($D_{max}=0.51$; $D_{min}=0.15$) and exhibited image smear.

EXAMPLE 2

A working strength liquid developer was prepared by mixing 2.6 g of developer concentrate as in Example 1 with 0.6 g of a polymeric solution containing 0.0875 g of chlorinated polyethylene (degree of chlorination—67%) and 0.5125 g of Solvesso 100. The mixture was diluted to 500 ml with Isopar G using an ultrasonic horn.

The developer had a particle size of up to $1\mu$ and was used to develop an electrostatic charge pattern as in Example 1. Images obtained were of excessively high density ($D_{max}=3.56$) with poor resolution. Developer stability was also poor.

EXAMPLE 3

A working strength liquid developer was prepared by mixing 2.6 g of developer concentrate as in Example 1 with 0.65 g of polymeric solution containing 0.0875 g of the chlorinated polyethylene and 0.5625 g of Solvesso 100, and 0.65 g of phosphonate stabilizer solution containing 0.0875 g of poly(vinyltoluene-co-lauryl methacrylate-co-ethyl hydrogen p-vinylbenzylphosphonate (47/47/6) and 0.5625 g of Solvesso 100. The mixture was diluted to 500 ml with Isopar G using an ultrasonic horn.

The developer had a particle size of up to $1\mu$ and was used to develop an electrostatic charge pattern as in Example 1. Images obtained were of good quality and resolution with a $D_{max}$ of 1.2 and $D_{min}$ of 0.15.

EXAMPLE 4

A concentrated liquid toner was prepared by dissolving 4.55 g of VT polymer in 44 g of Solvesso 100 and adding 3.5 g of Peerless 155 Carbon. The mixture was ball milled for 15 days using ⅛-inch steel balls.

A working strength liquid developer was prepared by mixing 2.6 g of the above concentrate with 0.6 of polymeric solution containing 0.0875 g of chlorinated polyethylene and 0.5125 g of Solvesso, as in Example 2, and 0.30 g of phosphonate stabilizer poly(vinyltoluene-co-lauryl methacrylate-co-ethyl hydrogen p-vinylbenzylphosphonate) (47/47/6).

The developer had a particle size of $<1\mu$ and was used to develop an electrostatic charge pattern as in Example 1. Images obtained were of high quality with a $D_{max}$ of 1.60, $D_{min}$ of 0.15, and resolution of 190–210 lines/mm. The developer has good stability and was used for one year.

EXAMPLE 5

A concentrated liquid toner was prepared consisting of 6.24 g of developer which contained 0.42 g of Peerless 155 Carbon, 0.42 g of VT polymer, and 5.4 g of Solvesso 100; 4.16 g of developer which contained 0.28 g of Toluidine Blue phosphotungstic acid, 0.28 g of VT polymer, and 3.64 g of Solvesso 100; 2.6 g of solution which contains 0.35 g of poly(vinyltoluene-co-lauryl methacrylate-co-ethyl hydrogen p-vinylbenzene phosphonate) (47/47/6) and 2.25 g of Solvesso 100. The concentrate was ball milled for 15 days. After ball milling, 2.6 g of solution which contained 0.35 g of chlorinated polyethylene Solvesso 100 was added; this mixture was tumbled on the ball mill for 45 minutes. The mixture was diluted using an ultrasonic horn by subjecting 48.6 g of Isopar G into the dispersion at the rate of 2ml per minute during sonification.

A working strength developer was prepared by mixing 15.6 g of the above concentrate with Isopar G to a total volume of 500 ml of developer.

An electrostatic charge pattern on zinc oxide paper was developed with this composition. Good images were obtained with $D_{max}$ of 0.87, $D_{min}$ Of 0.15, and resolution of 150–200 lines/mm.

It can be noted by comparing the results of Examples 3–5 with the controls of Examples 1 and 2 that the developer made in accord with the teachings of the present invention are far superior to control developers that do not contain, in combination, a polar moiety-containing polymer, a phosphonate moiety-containing polymer, and a halogenated polymer.

The invention has been described in detail with particular reference to certain preferred embodiments thereof, but it will be understood that variations and modifications can be effected within the spirit and scope of the invention.

We claim:

1. An electrographic developer composition comprising an electrically insulating carrier liquid having dispersed therein (1) an addition polymer comprising a polar moiety and at least one additional moiety having predetermined solubility characteristics with respect to the carrier liquid, said polar moiety being selected from the group consisting of (a) sulfoalkyl acrylates, (b) sulfoalkyl methacrylates, (c) metal salts of sulfoalkyl acrylates, (d) metal salts of sulfoalkyl methacrylates, (e) amine salts of sulfoalkyl acrylates, (f) amine salts of sulfoalkyl methacrylates, (g) metal salts of acrylic cid and methacrylic acids and (h) amine salts of acrylic and methacrylic acids, and mixtures thereof;

(2) a soluble phosphonic moiety-containing polymer having repeating units derived from a monomer of the formula:

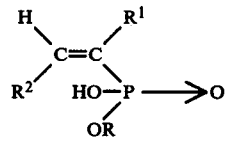

or

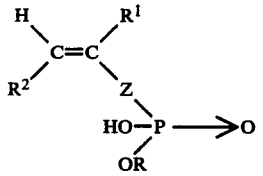

wherein:

R is hydrogen, an alkyl group or an aryl group;

$R^1$ is hydrogen or a lower group having from 1 to about 4 carbon atoms;

$R^2$ is hydrogen or an alkyl group; and

Z is alkylene, arylene or alkylene-arylene; the solubility ratio of said soluble phosphonic moiety-containing polymer being at least about 0.825; and (3) a halogenated polymer.

2. A composition of claim 1 wherein said halogenated polymer is selected from the group consisting of halogenated polyolefins, halogenated paraffins and halogenated rubbers.

3. A composition of claim 1 which comprises from about 0.01 to about 5% by weight of said addition polymer comprising a polar moiety, from about 0.01 to about 5% by weight of phosphonic moiety-containing polymer and from about 0.01 to about 5% by weight of halogenated polymer.

4. A composition of claim 1 wherein said halogenated polymer is chlorinated polyethylene.

5. A composition of claim 1 wherein said halogenated polymer is poly(vinyl chloride-co-vinylidene chloride).

* * * * *